US009053915B2

(12) United States Patent
Ristroph et al.

(10) Patent No.: US 9,053,915 B2
(45) Date of Patent: Jun. 9, 2015

(54) RADIO FREQUENCY (RF) ION GUIDE FOR IMPROVED PERFORMANCE IN MASS SPECTROMETERS AT HIGH PRESSURE

(71) Applicant: Agilent Technologies, Inc., Loveland, CO (US)

(72) Inventors: Trygve Ristroph, Fremont, CA (US); Gershon Perelman, Cupertino, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 200 days.

(21) Appl. No.: 13/626,698

(22) Filed: Sep. 25, 2012

(65) Prior Publication Data

US 2014/0084156 A1 Mar. 27, 2014

(51) Int. Cl.
*H01J 49/06* (2006.01)

(52) U.S. Cl.
CPC ..... *H01J 49/065* (2013.01); *H01J 49/066* (2013.01); *H01J 49/062* (2013.01); *H01J 49/067* (2013.01)

(58) Field of Classification Search
CPC ..... H01J 49/065; H01J 49/066
See application file for complete search history.

(56) References Cited

U.S. PATENT DOCUMENTS

| | | | | |
|---|---|---|---|---|
| 5,572,035 | A | 11/1996 | Franzen | |
| 6,069,355 | A | 5/2000 | Mordehai | |
| 6,107,628 | A | 8/2000 | Smith et al. | |
| 6,452,167 | B1 * | 9/2002 | Felter | 250/292 |
| 6,583,408 | B2 | 6/2003 | Smith et al. | |
| 6,642,514 | B2 * | 11/2003 | Bateman et al. | 250/288 |
| 7,064,322 | B2 | 6/2006 | Crawford et al. | |
| 7,495,212 | B2 | 2/2009 | Kim et al. | |
| 7,564,025 | B2 | 7/2009 | Crawford | |
| 7,960,693 | B2 * | 6/2011 | Syms et al. | 250/292 |
| 8,299,443 | B1 * | 10/2012 | Shvartsburg et al. | 250/396 R |
| 2004/0135080 | A1 | 7/2004 | Ouyang et al. | |
| 2010/0301210 | A1 | 12/2010 | Bertsch et al. | |
| 2011/0315873 | A1 | 12/2011 | Makarov et al. | |
| 2013/0175440 | A1 * | 7/2013 | Perelman et al. | 250/288 |

FOREIGN PATENT DOCUMENTS

| | | | |
|---|---|---|---|
| WO | WO2006059123 | A2 | 6/2006 |
| WO | WO2008067331 | A2 | 6/2008 |

OTHER PUBLICATIONS

Co-pending U.S. Appl. No. 13/345,392, filed Jan. 6, 2012.
Gerlich, "Inhomogeneous RF Fields: A versatile tools for the study of processes with slow ions", State-Selected and State-to-State Ion-Molecule Reaction Dynamics, Advances in Chemical Physics Series, vol. 82, pp. 1-176, Wiley, New York, 1992.
Masuda, "Confinement and Transportation of Charged Aerosol Clouds via Electric Curtain", Electrical Engineering in Japan, vol. 92, No. 1, 1972, p. 43-52.
International Search Report and Written Opinion mailed Dec. 2, 2013 for International Application No. PCT/US2013/056387.

* cited by examiner

*Primary Examiner* — Jack Berman

(57) ABSTRACT

Ion guides for use in mass spectrometry (MS) systems are described. The ion guides are configured to provide a reflective electrodynamic field and a direct current (DC or static) electric field to provide ion beams that are more spatially confined with a comparatively large mass range. Some ion guides are provided between the ion source and the first stage vacuum chamber of the MS system.

9 Claims, 10 Drawing Sheets

RADIO FREQUENCY (RF) ION GUIDE FOR IMPROVED PERFORMANCE IN MASS SPECTROMETERS AT HIGH PRESSURE

BACKGROUND

Mass spectrometry (MS) is an analytical methodology used for quantitative elemental analysis of samples. Molecules in a sample are ionized and separated by a spectrometer based on their respective masses. The separated analyte ions are then detected and a mass spectrum of the sample is produced. The mass spectrum provides information about the masses and in some cases the quantities of the various analyte particles that make up the sample. In particular, mass spectrometry can be used to determine the molecular weights of molecules and molecular fragments within an analyte. Additionally, mass spectrometry can identify components within the analyte based on a fragmentation pattern.

Analyte ions for analysis by mass spectrometry may be produced by any of a variety of ionization systems. For example, Atmospheric Pressure Matrix Assisted Laser Desorption Ionization (AP-MALDI), Atmospheric Pressure Photoionization (APPI), Electrospray Ionization (ESI), Atmospheric Pressure Chemical Ionization (APCI) and Inductively Coupled Plasma (ICP) systems may be employed to produce ions in a mass spectrometry system. Many of these systems generate ions at or near atmospheric pressure (760 Torr). Once generated, the analyte ions must be introduced or sampled into a mass spectrometer. Typically, the analyzer section of a mass spectrometer is maintained at high vacuum levels from $10^{-4}$ Torr to $10^{-8}$ Torr. In practice, sampling the ions includes transporting the analyte ions in the form of a narrowly confined ion beam from the ion source to the high vacuum mass spectrometer chamber by way of one or more intermediate vacuum chambers. Each of the intermediate vacuum chambers is maintained at a vacuum level between that of the proceeding and following chambers. Therefore, the ion beam transports the analyte ions and transitions in a stepwise manner from the pressure levels associated with ion formation to those of the mass spectrometer. In most applications, it is desirable to transport ions through each of the various chambers of a mass spectrometer system without significant ion loss. Often an ion guide is used to move ions in a defined direction in the MS system.

Ion guides typically use electromagnetic fields to confine the ions radially while allowing or promoting ion transport axially. One type of ion guide generates a multipole field by application of a time-dependent voltage, which is often in the radio frequency (RF) spectrum. These so-called RF multipole ion guides have found a variety of applications in transferring ions between parts of MS systems, as well as components of ion traps. Often, ion guides are also operated in presence of a buffer gas to reduce the velocity of ions in both axial and radial directions. This reduction in ion velocity in the axial and radial directions is known as "thermalizing" or "cooling" the ion populations due to multiple collisions of ions with neutral molecules of the buffer gas, and the resultant transfer of kinetic energy. Thermalized beams that are compressed in the radial direction are useful in improving ion transmission through orifices of the MS system and reducing radial velocity spread in time-of-flight (TOF) instruments. RF multipole ion guides create a pseudo potential well, which confines ions inside the ion guide.

Beam limiting apertures are used to limit transverse spatial width and angular spread (beam divergence) of the ion beam. Limiting the spatial width and angular spread of the ion beam is useful because ion trajectories, which deviate too much from the beam axis in either transverse position or angular heading, can lead to a dispersion in the mass analyzer. This dispersion in the mass analyzer is based on ion initial conditions rather than purely on ion mass. For example, in an "ideal" TOF MS system, the ion time of flight only depends on the ion mass, since that is the quantity to be measured. In reality, time of flight depends weakly on the exact spatial location and angular heading of each ion. The spread of positions and angular deviations causes a spread in time of flight and reduces the mass resolution of the TOF MS system. Consequently, in many mass analyzers the beam size and angular spread are limited with a set of two consecutive apertures in a field free region, sometimes referred to as a slicer, which prevents ions outside the acceptable range from entering the analyzer.

While beam limiting apertures are useful in improving precision in mass measurements, known MS systems that incorporate beam limiting apertures in the ion guide have certain drawbacks. First, beam limiting apertures reduce the overall mass spectrometer sensitivity by preventing a significant portion of the ion beam from entering the mass analyzer. Second, ions that are incident on the metal surface comprising the beam limiting aperture can contaminate the metal surface over time and distort the electrostatic fields in the vicinity. This field distortion can alter the ion beam direction, which can degrade mass resolution and sensitivity, cause the system to be unstable, and block the beam all together.

To minimize the effects of these problems associated with the known slicer, it is desirable to condition the ion beam so that a large portion of the ion beam will pass through the apertures. In known MS systems, a series of electrostatic lenses focuses the ion beam for optimal coupling through the apertures of the slicer. However, in known MS systems, even with optimal coupling, transmission through the slicer is limited by the beam emittance, which is defined as the product beam spatial size and angular spread. This fundamental limitation is a direct consequence of the conservation of phase space density. Reducing the beam emittance as much as possible is therefore desirable. Beam brightness, which is defined as the ion beam current divided by the beam emittance, is desirably increased by reducing the beam emittance. However, known ion guides do not suitably confine low beam emittance.

In a known gas buffer device, ions reach approximate thermal equilibrium with the buffer gas and then are subsequently accelerated to at least several electron volts of axial energy after leaving the gas filled region. The final emittance has two contributions, angular spread and spatial spread, both of which are influenced by the buffer gas cooling process in the ion guide. In the limiting case, the final angular spread is given simply by the ratio of the thermal velocity to axial velocity, a quantity known as the thermal angular spread. Practical devices get close to the thermal spread at room temperature. In known ion guides, reducing the angular spread further requires costly refrigeration of the buffer gas and consequently is rarely pursued in mass spectrometry.

In addition, as noted above many mass spectrometer ion sources function more efficiently at comparatively high ambient pressures (e.g., near 1 atm (760 Torr)). By contrast, most mass spectrometers function at significantly lower pressures. For example, the pressures maintained inside the MS vacuum chamber are from $10^{-4}$ Torr to $10^{-8}$ Torr. Transferring ions from the ion source to the chamber using many known techniques results in significant losses of ions.

While ion guides, such as known multipole ion guides, are useful in guiding ions in MS systems, these known ion guides are not practical for use at comparatively high pressures (e.g., near atmospheric temperatures). Specifically, at comparatively low pressures ion confinement using known ion RF multipole ion guides is acceptable. However, ion confinement and guidance using known ion guides becomes unacceptable at pressures above a certain pressure that is well below the suitable pressure for the ion source.

Two common problems limit the maximum functional pressure for known ion guides. First, the length scales, or the distance between the electrodes of known ion guides, are too great and as a result the pressure at which electrostatic breakdown occurs is unacceptably low. Moreover, at higher pressures, the RF power required to effect suitable ion confinement can be too great for practical implementation.

What is needed, therefore, is an apparatus that overcomes at least the shortcomings of known structures described above.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms 'a', 'an' and 'the' include both singular and plural referents, unless the context clearly dictates otherwise. Thus, for example, 'a device' includes one device and plural devices.

As used herein, the term 'multipole ion guide' is an ion guide configured to establish a quadrupole, or a hexapole, or an octopole, or a decapole, or higher order pole electric field to direct ions in a beam.

As used in the specification and appended claims, and in addition to their ordinary meanings, the terms 'substantial' or 'substantially' mean to with acceptable limits or degree. For example, 'substantially cancelled' means that one skilled in the art would consider the cancellation to be acceptable.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

Figure 1:
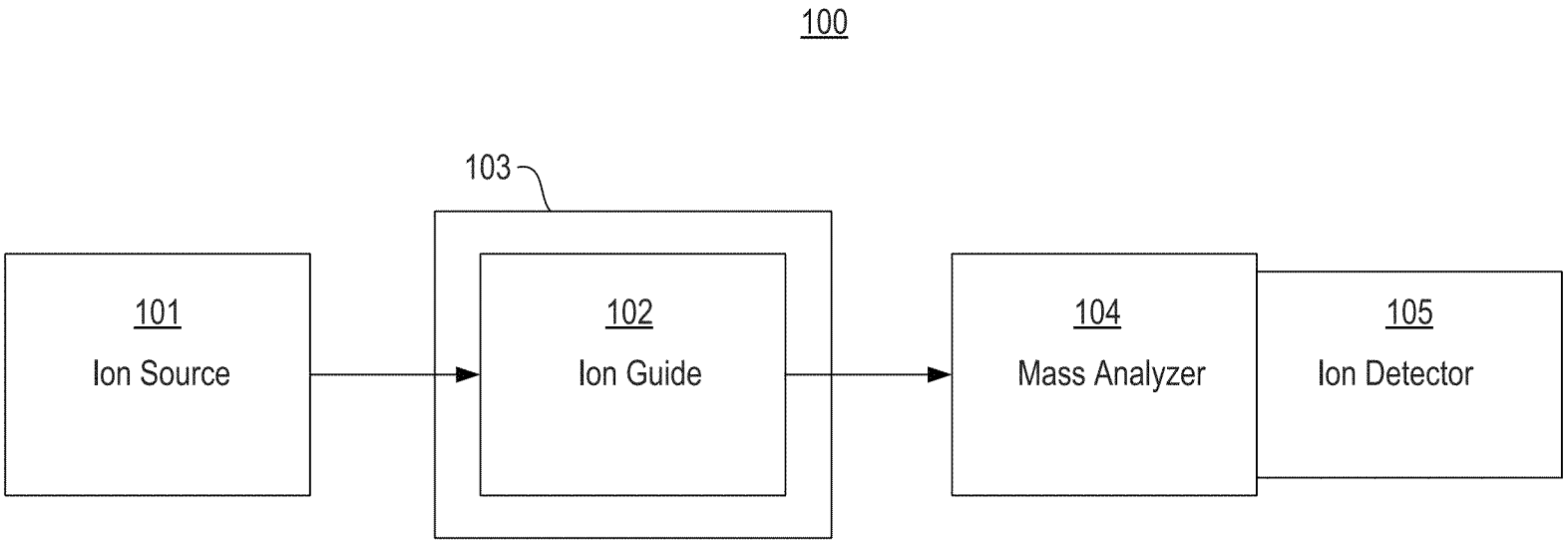
FIG. 1 shows a simplified block diagram of an MS system in accordance with a representative embodiment.

FIG. 1 shows a simplified block diagram of an MS system 100 in accordance with a representative embodiment. The MS system 100 comprises an ion source 101, an ion guide 102, a collision chamber 103, a mass analyzer 104 and an ion detector 105. The ion source 101 may be one of a number of known types of ion sources. The mass analyzer 104 may be one of a variety of known mass analyzers including but not limited to a time-of-flight (TOF) instrument, a Fourier Transform MS analyzer (FTMS), an ion trap, a quadrupole mass analyzer, or a magnetic sector analyzer. Similarly, the ion detector 105 is one of a number of known ion detectors.

The ion guide 102 is described more fully below in connection with representative embodiments. The ion guide 102 may be provided in the collision chamber 103, which is configured to provide one or more pressure transition stages that lie between the ion source 101 and the mass analyzer 104. Because the ion source 101 is normally maintained at or near atmospheric pressure, and the mass analyzer 104 is normally maintained at comparatively high vacuum, according to representative embodiments, the ion guide 102 may be configured to transition from comparatively high pressure to comparatively low pressure. The ion source 101 may be one of a variety of known ion sources, and may include additional ion manipulation devices and vacuum partitions, including but not limited to skimmers, multipoles, apertures, small diameter conduits, and ion optics. In one representative embodiment, the ion source 101 includes its own mass filter and the collision chamber 103 may be provided in a chamber (not shown). In mass spectrometer systems comprising collision chamber 103 including the ion guide 102, a neutral gas may be introduced into the included collision chamber 103 to facilitate fragmentation of ions moving through the ion guide 102. Such a collision cell used in multiple mass/charge analysis systems is known in the art as "triple quad" or simply, "QQQ" systems.

In alternative embodiments, the collision cell is included in the source and the ion guide 102 is in its own collision chamber 103. In yet another embodiment, the collision cell and the ion guide 102 are separate devices in the same collision chamber 103.

In use, ions (the path of which is which is shown by arrows) produced in ion source 101 are provided to the ion guide 102. The ion guide 102 moves the ions and forms a comparatively confined beam having a defined phase space determined by selection of various guide parameters, as described more fully below. The ion beam emerges from the ion guide 102 and is introduced into the mass analyzer 104, where ion separation occurs. The ions pass from mass analyzer 104 to the ion detector 105, where the ions are detected.

Figure 2:
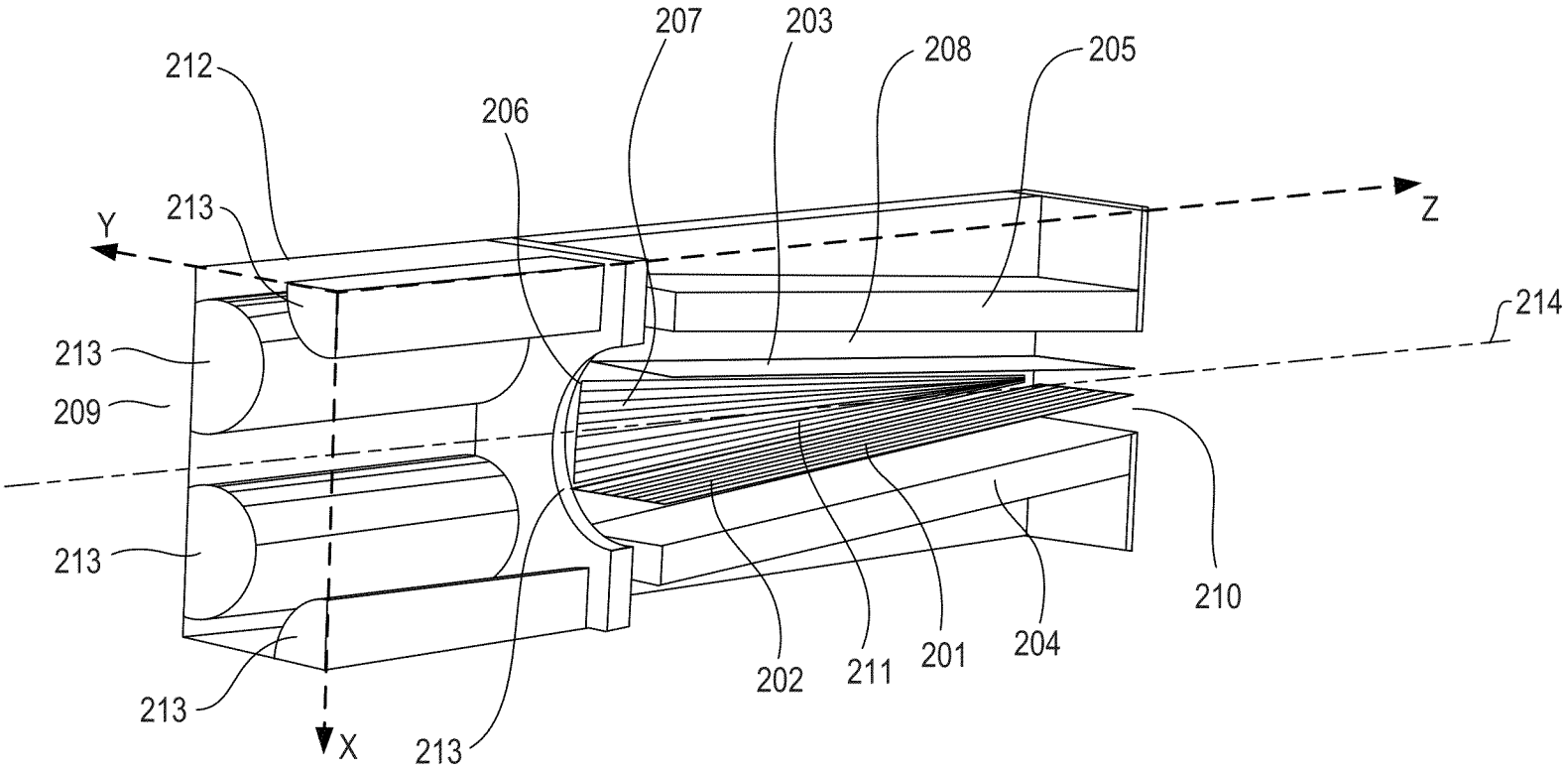
FIG. 2 shows a perspective view of an ion guide in accordance with a representative embodiment.

FIG. 2 shows a perspective view of an ion guide 200 in accordance with a representative embodiment. The ion guide 200 comprises a first substrate 201 comprising a first plurality of electrodes 202 disposed thereover, and a second substrate 203 opposing the first substrate 201 and comprising a second plurality of electrodes (not shown in FIG. 2) disposed thereover. For ease of description, the first and second substrates 201, 203 are shown detached from respective bases 204, 205. The first substrate 201 opposes the second substrate 203, with respective first and second pluralities of electrodes disposed in an opposing manner. As such, the first plurality of electrodes 202 opposes the second plurality of electrodes, which cannot be seen in FIG. 2. In certain embodiments, a third substrate 206 comprising a third plurality of electrodes 207 is disposed over a side wall 208 of the ion guide 200. The third substrate 206 is oriented substantially orthogonally to the planes of the first and second substrates 201, 203. A fourth substrate (not shown) comprising a fourth plurality of electrodes (not shown) is disposed opposing the third substrate 206, and parallel to the plane of the third substrate 206 to complete four sides of the ion guide 200. In certain embodiments, rather than a plurality of electrodes, the third substrate 206 and the fourth substrate (not shown) each comprise an electrically conductive material disposed over respective entire surfaces. Notably, the side walls (e.g., side wall 408) can comprise electrically insulating material with an electrically conductive layer or patterned electrodes made of an electrically conductive material disposed thereon. Alternatively, the sidewalls can also be made of electrically conductive material.

In the embodiment depicted, the first through fourth substrates are separate elements from and disposed over respective bases and side walls. However, this is not essential and it is contemplated that the pluralities of electrodes are formed directly on respective bases and side walls of the ion guide 200. In a representative embodiment, the first substrate 201, the second substrate 203, the third substrate 206 and the fourth substrate (not shown) each comprise a dielectric material and the first through fourth pluralities of electrodes disposed thereover each comprise an electrically conductive material such as a metal or an alloy. The electrodes may comprise a plurality of layers of the electrically conductive material. In a representative embodiment, the first through fourth substrates comprising first through fourth pluralities of electrodes may be as described in U.S. Pat. No. 5,572,035 to Franzen, the disclosure of which is specifically incorporated herein by reference.

Illustratively, the first through fourth pluralities of electrodes have a width of approximately 5 μm to approximately 500 μm, a thickness of approximately 0.1 μm to approximately 50 μm, and a pitch of approximately 10 μm to approximately 1000 μm. Beneficially, the first through fourth pluralities of electrodes are amenable to known small dimension fabrication methods common in the microelectronics industry.

Many options for fabricating the electrodes are available. Photolithography and physical or chemical deposition methods commonly used in the construction of electronic and semiconductor circuits could be used to pattern the electrodes. Additionally, separated stacked plates with successively smaller holes could also be used. For example, photolithographic and physical or chemical deposition methods commonly used in the fabrication of electronic, microelectronic and semiconductor structures may be used to fabricate the narrow and narrowly spaced electrodes (e.g., first plurality of electrodes 202) of the representative embodiments. Methods for depositing the electrodes that are known in integrated circuit fabrication (e.g., known thin and thick film depositions on semiconductor or insulating substrates) are contemplated. Accordingly, and as described below, a desired degree of ion beam confinement and improved mass range transmission can be realized with the ion guide 200 having electrodes fabricated using known methods.

The first substrate 201 and the second substrate 203 form sides of a first opening at a first end 209 of the ion guide 200 and sides of a second opening at a second end 210 of the ion guide 200.

The first through fourth pluralities of electrodes are substantially parallel on their respective substrates and are selectively connected to a power supply/voltage source (not shown in FIG. 2) configured to apply opposite phases of an time dependent voltage (e.g., a radio frequency (RF) voltage) to adjacent pairs of the first plurality of electrodes 202, between adjacent pairs of the second plurality of electrodes (not shown), between adjacent pairs of the third plurality of electrodes 207 and between adjacent pairs of the fourth plurality of electrodes (not shown) to create an ion confining electrodynamic field in a region 211 between the first through fourth substrates. The confining electrodynamic field reflects ions back toward the center of the region 211 and thereby confines the ions as they travel between the first end 209 and the second end 210 of the ion guide 200. It is emphasized that in certain embodiments, the time dependent voltage is applied only between the selected pluralities of electrodes of opposing pairs of first through fourth substrates. For example, the time dependent voltage may be applied only to the first plurality of electrodes 202 of the first substrate 201 and the second plurality of electrodes of the second substrate 203.

The alternating voltage is an RF voltage applied between adjacent pairs of electrodes of each of the first through fourth pluralities and creates an electrodynamic field in the region 211. As described below, the amplitude of the RF voltage can change along the lengths (parallel to the z-direction of the depicted coordinate system) of the respective of the first through fourth pluralities of electrodes to achieve certain desired results. Alternatively, the amplitude is maintained approximately constant between each of the first through fourth pluralities of electrodes along their respective lengths. In a representative embodiment, the RF voltage typically has a frequency ($\omega$) in the range of approximately 1.0 MHz to approximately 100.0 MHz. The frequency is one of a number of ion guide parameters useful in achieving efficient beam compression and mass range of analytes. In addition, and as described more fully below, a direct current (DC) voltage is also applied and creates an electrical potential difference to guide ions in the z direction. As described more fully below, the potential difference usefully nullifies a potential barrier created by the electrodynamic field, and serves to force the ions from the input to the output of the ion guide 200. Moreover, the potential difference allows the ions to overcome any resistance due to buffer gas in the ion guide 200.

The comparatively small width and pitch of the first plurality of electrodes 202, the second plurality of electrodes (not shown), and optionally, the third plurality of electrodes 207 and the fourth plurality of electrodes (not shown) beneficially results in an RF field that is maintained comparatively "close" to the electrodes and their respective first, second and third substrates 201, 203, 206. As such, the RF field produced by the RF voltage applied to the first plurality of electrodes 202, the second plurality of electrodes (not shown), and optionally, the third plurality of electrodes 207 and the fourth plurality of electrodes (not shown) is insignificant at the axis 214. This prevents the establishment of a reflective RF field at the second end 210 and the undesired reflection of the ions at the second end 210 away from the second end 210 and toward the first end 209 of the ion guide 300 (i.e., in the −z direction of the coordinate system depicted in FIG. 2)

As described more fully below, a power supply/voltage source is selectively connected to the electrodes of the first through fourth substrates to establish a direct current (DC) voltage drop between the first end 209 and the second end 210, to effect drift of ions from the first end 209 and the second end 210 of the ion guide 200. Alternatively, if the third substrate 206 and the fourth substrate (not shown) are covered with an electrically conductive layer, the power supply may be connected to these conductive layers to establish a DC voltage drop between the first end 209 and the second end 210. More generally, the DC voltage may be applied only between the selected pluralities of electrodes of opposing pairs of electrodes of the first through fourth substrates. For example, the DC voltage may be applied only to the third plurality of electrodes (or electrically conductive layer) 207 of the third substrate 206 and the fourth plurality of electrodes (or electrically conductive layer) of the fourth substrate (not shown).

Notably, the DC voltage level applied to the pluralities of electrodes (or electrically conductive layers as applicable) of the first through fourth substrates at the first end 209 is not the same as the DC voltage level applied to the pluralities of electrodes of the first through fourth substrates at the second end 210 to provide a DC electric field and potential drop between the first end 209 and the second end 210 of the ion guide 200. In representative embodiments, the DC voltage difference is selected to nullify any electrical potential barriers created by the RF electric field, and to overcome ion stalling due to ion collisions with a buffer gas (not shown) in the ion guide 200, thereby forcing the ions from the first end 209 to the second end 210 of the ion guide 200.

In certain embodiments, the first and second substrates 201, 203 are "tilted" in a downward fashion to create a taper in the ion guide 200, such as depicted in FIG. 2. Illustratively, the first and second substrates 201, 203 are disposed at a comparatively shallow angle relative to the axis 214. Illustratively, the first and second substrates 201, 203 are disposed at an angle of approximately 0.50° to approximately 10° relative to the axis 214. As can be appreciated, the height (z-direction in the coordinate axis of FIG. 2) of the third substrate 206 and the height of the fourth substrate (not shown) are smaller at the second end 210 than at the first end 209 to accommodate this taper. The taper provides an opening of the ion guide 200 at the second end 210 having an area that is less that of an opening at the first end 209 of the ion guide 200.

As described more fully below, the taper in concert with the confining electric field provided by the RF voltage serves to further confine the ions during travel between the first end 209 and the second end 210, and reduce the beam emittance of the ion guide 200.

In the coordinate system depicted in FIG. 2, the first and second pluralities of the first and second substrates 201, 203 are disposed in a plane that is orthogonal to the x-z plane of the coordinate system depicted in FIG. 2. By contrast, the third plurality of electrodes 207 of the third substrate 206, and the fourth plurality of electrodes (not shown) of the fourth substrate (not shown) are each disposed in the x-z plane of the coordinate system of FIG. 2.

In the presently described representative embodiment, the ion guide 200 is coupled at the first end 209 to a multipole ion guide 212. The multipole ion guide 212 comprises a plurality of rods 213 in a converging arrangement having an input (not shown) and an output at a distal end of the input and immediately adjacent to the first end 209 of the ion guide 200. In a representative embodiment described more fully below, the rods 213 are disposed around an axis 214 that is parallel to the z-axis in the coordinate system shown, and lies between the first and second substrates 201, 203.

In a representative embodiment, the rods 213 are comprised of insulating material, which can be ceramic or other suitable material. The rods 213 also comprise a resistive outer layer (not shown). The resistive outer layer allows for the application of a DC voltage difference between the respective first ends and the respective second ends of the rods 213. In one embodiment, rods 213 may be configured as described in commonly owned U.S. Patent Application Publication 20100301210 entitled "Converging Multipole Ion Guide for Ion Beam Shaping" to Bertsch, et al. Additionally, the rods 213 may be as described in commonly owned U.S. Pat. No. 7,064,322 to Crawford, et al. and titled "Mass Spectrometer Multipole Device." The entire disclosures of the referenced patent application publication to Bertsch, et al. and the patent to Crawford, et al. are specifically incorporated herein by reference and for all purposes.

The rods 213 may have a conducting inner layer and resistive outer layer, which configure each of the rods 213 as a distributed capacitor for delivering the RF voltage to the resistive layer of each of the rods 213. The inner conductive layer delivers the RF voltage through a thin insulation layer (not shown) to the resistive layer. Such a configuration is described in the incorporated reference to Crawford, et al., and serves to reduce deleterious heating of the rods 213 resulting from induced currents of the RF fields.

The multipole ion guide 212 provides a first stage of confinement to ions that enter at the first end 209 of the ion guide 200. As described more fully below, through a combination of ion confinement by the electrodynamic fields established by the ion guide and cooling of the ions as they travel between the first end 209 and the second end 210 of the ion guide 200, an ion beam that is comparatively more confined ("brighter") with a comparatively large mass range is realized. Illustratively, the ion guide 200 confines the ion beam within a range of 50 μm to approximately 150 μm for masses ranging from approximately 50 amu to approximately 3000 amu.

Figure 3:
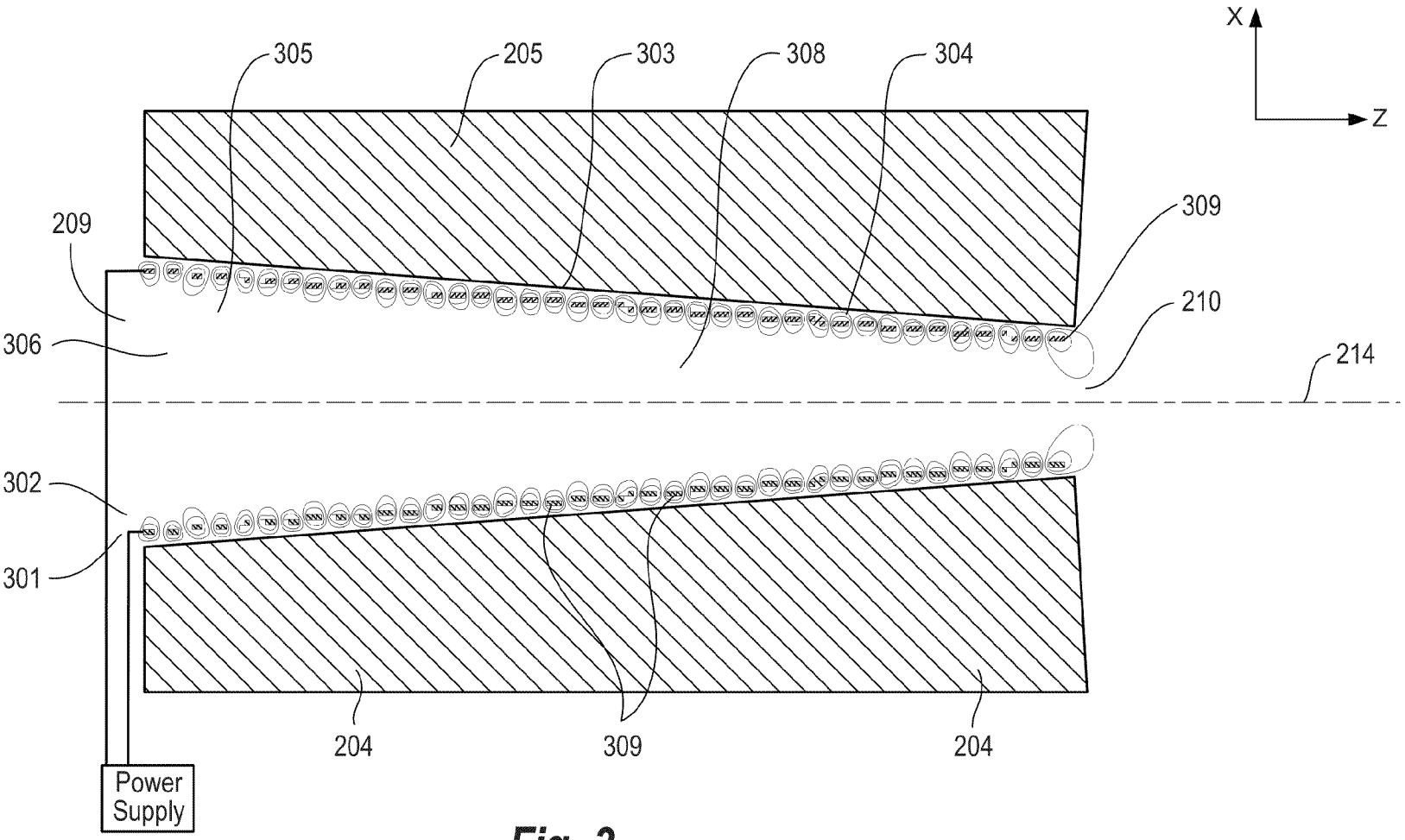
FIG. 3 shows a cross-sectional view of an ion guide in accordance with a representative embodiment.

FIG. 3 shows a cross-sectional view of an ion guide 300 in accordance with a representative embodiment. Many details of the components and their materials and function are similar if not identical to the description of ion guide 200 presented above. These common details may not be repeated in order to avoid obscuring the description of the presently described embodiment.

Ion guide 300 comprises a first substrate 301 comprising a first plurality of electrodes 302 disposed thereover, and a second substrate 303 opposing the first substrate 301 and comprising a second plurality of electrodes 304 disposed thereover. The first substrate 301 is provided over base 204 and the second substrate 303 is disposed over base 205. The respective first and second pluralities of electrodes 302, 304 are disposed in an opposing manner. Notably, however, the orientation of the first and second pluralities of electrodes 302, 304 are oriented in a direction that is orthogonal to the orientation of the pluralities of electrodes described in conjunction with the embodiments of FIG. 2. Specifically, the first and second pluralities of electrodes 302, 304 are substantially perpendicular to the x-z plane (i.e., parallel to the y direction) of the coordinate system depicted in FIG. 3. In certain embodiments, a third substrate 305 is disposed over a side wall (not shown in FIG. 3) of the ion guide 300 and is oriented substantially orthogonally to the planes of the first and second substrates 201, 203. A fourth substrate (not shown) comprising a fourth plurality of electrodes (not shown) is disposed opposing the third substrate 305, and parallel to the plane of the third substrate 305 to complete four sides of the ion guide 200. Illustratively, the third substrate 305 comprises an electrically conductive layer 306 disposed over its entire surface. Similarly, the fourth substrate (not shown) comprises an electrically conductive material (not shown) disposed over its entire surface. Alternatively, the third substrate 305 comprises a third plurality of electrodes (not shown) and a fourth plurality of electrodes (not shown) disposed in an opposing manner, such as described in connection with the embodiments of FIG. 2.

A power supply 307 is selectively connected to provide an RF voltage and a DC voltage to the ion guide 300. In a representative embodiment, the RF voltage is applied between adjacent pairs of electrodes of each of the first and second pluralities of electrodes 302, 304 to create an electrodynamic field having equipotential lines 309 in a region 308 between the first and second pluralities of electrodes 302, 304. Similarly, if third and fourth pluralities of electrodes were incorporated on the third substrate 305 and the fourth substrate (not shown) as contemplated by a representative embodiment of the present teachings, the power supply 307 would be selectively connected to provide an RF voltage applied between adjacent pairs of electrodes disposed on the third and fourth substrates (not shown) and creates an electrodynamic field having equipotential lines 309 in the region 308.

The comparatively small width and pitch of the first and second pluralities of electrodes 302, 304 beneficially results in an RF field that is maintained comparatively "close" to the electrodes and their respective substrates. As such, the RF field produced by the RF voltage applied to the first and second pluralities of electrodes 302, 304 (and, optionally, the third and fourth pluralities of electrodes) is insignificant at the axis 214. This prevents reflection of the ions at the second end 210 away from the second end 210 and toward the first end 209 of the ion guide 300 (i.e., in the −z direction of the coordinate system depicted in FIG. 3).

The RF field created by the application of the RF voltage to the first and second pluralities of electrodes 302, 304 in the region 308 is configured to reflect or repel ions away from the first and second substrate 301, 303. Similarly, if third and fourth pluralities of electrodes (not shown) are provided in the opposing manner described above, the RF field created by the application of the RF voltage to the third and fourth pluralities of electrodes (not shown) in the region 308 is configured to reflect or repel ions away from the third substrate 305 and the fourth substrate (not shown). This repelling of ions serves to confine ions in the region 308.

In a representative embodiment, the DC voltage is applied by the power supply 307 to the first plurality of electrodes 302 and the second plurality of electrodes 304 in a manner to create a DC potential difference created between the first end 209 and the second end 210 of the ion guide 300. Similarly, if third and fourth pluralities of electrodes (not shown) are provided in the opposing manner described above, a DC field is created by the application of the DC voltage to the third and fourth pluralities of electrodes (not shown) in the region 308.

In another representative embodiment the third substrate 305 comprises an electrically conductive layer 306 and the fourth substrate (not shown) comprises an electrically resistive material (not shown) disposed over their respective entire surfaces. The DC voltage is applied by the power supply 307 to the electrically conductive layers in a manner to create a DC potential difference between the first end 209 and the second end 210 of the ion guide 300.

The DC potential difference selectively applied to the pluralities of electrodes (e.g., first and second pluralities of electrodes 302, 304), or the electrically conductive layers (e.g., electrically conductive layer 306) results in an electrostatic (DC) force on ions between the first end 209 and the second end 210 along the length (i.e., z− direction in the coordinate system depicted in FIG. 3). The DC force provided by the applied DC voltage serves to guide ions from the first end 209 to the second end 210 of the ion guide 300.

Ions introduced into the first end 209 of the ion guide 300 are reflected by the RF field, and at the same time are subjected to the drift forces due to the DC potential that propels the ions toward the second end 210 of the ion guide 300. Because of the tapering of the ion guide 300 between the first end 209 and the second end 210 and the reflection of the ions by the RF field away from the side walls and bases 204, 205, the ions are more confined in the region 308 at the second end 210 than at the first end 209. While the increased confinement serves to increase the energy spread of the ions at the second end 210, as described more fully below, the inclusion of a buffer gas in region 308 serves to dampen the increased energy spread, resulting in an increase in the brightness, or equivalently a reduction in emittance, in the compressed ion beam. Ultimately, the ion beam that is provided at the second end 210 has a "brightness" that is as much as approximately one order of magnitude when compared to ion beams realized by known ion guides.

Figure 4:
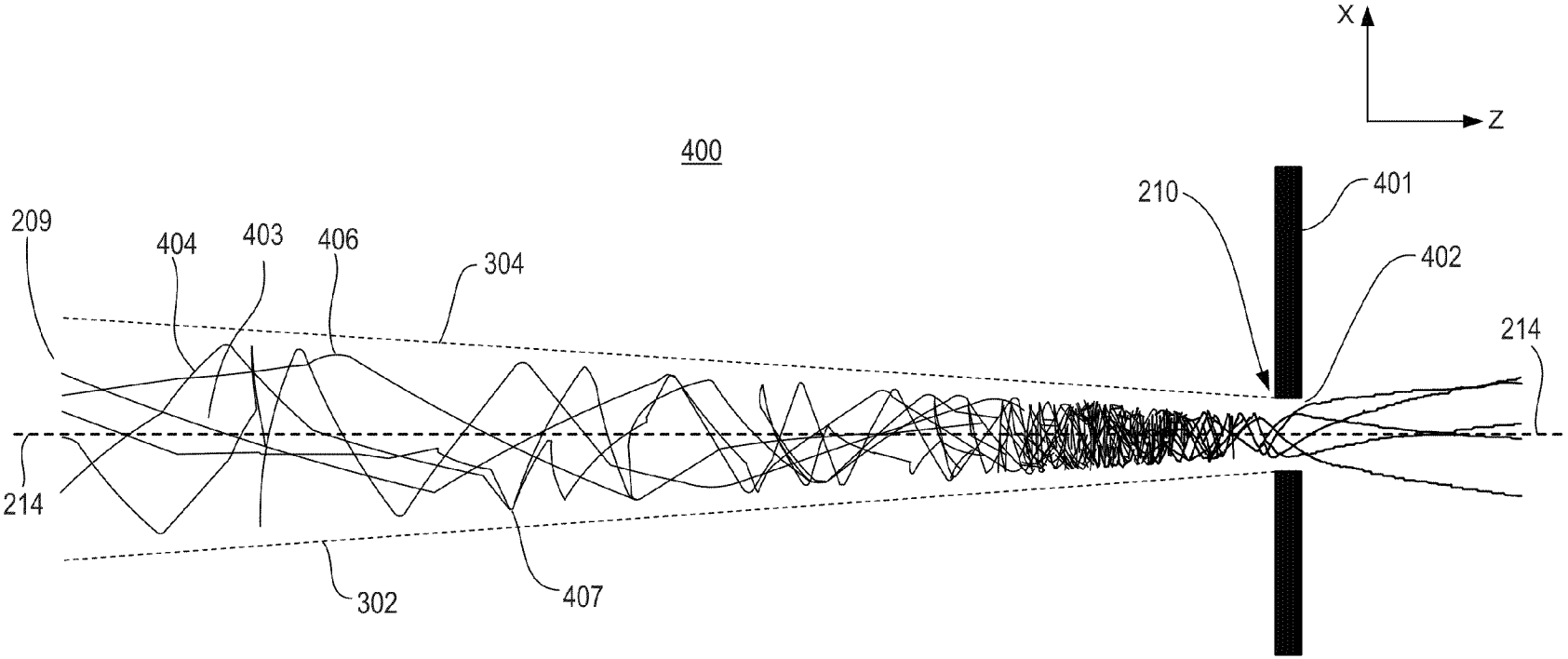
FIG. 4 shows a cross-sectional view of an ion guide in accordance with a representative embodiment.

FIG. 4 shows a cross-sectional view of an ion guide 400 in accordance with a representative embodiment. Many details of the components and their materials and functions are similar if not identical to those presented above in the description of ion guides 200, 300. These common details may not be repeated in order to avoid obscuring the description of the presently described embodiment.

Ion guide 400 comprises first plurality of electrodes 302 and second plurality of electrodes 304 opposing each other. The first and second pluralities of electrodes 302, 304 are at a comparatively shallow angle, illustratively approximately 0.5° to approximately 10° relative to axis 214. The shallow angle allows the buffer gas to continuously damp out the increased transverse kinetic energy spread that results from the continuous spatial size reduction caused by the taper of the ion guide 400 between the first end 209 and the second end 210.

Illustratively, the first and second pluralities of electrodes 302, 304 are oriented orthogonally to the x-z plane in the coordinate system depicted in FIG. 4. Alternatively, the first and second pluralities of electrodes could be disposed as described above in connection with the teachings of FIG. 2. Moreover, ion guide 400 could also comprise third and fourth substrates (not shown in FIG. 4) oriented in the x-z plane and comprise either third and fourth pluralities of electrodes (not shown) or be substantially covered by electrically conductive layers as described above.

Ion guide 400 comprises an end wall 401 disposed at the second end 210. The end wall 401 comprises an aperture 402 through which ions travel upon exiting the ion guide 400. In a representative embodiment, the end wall 401 comprises an aperture 402 through which ions travel after confinement by the ion guide 300 and cooling by a buffer gas provided in region 403 between the first and second pluralities of electrodes 302, 304.

In a representative embodiment, the aspect ratio (ratio of the y dimension to the x dimension in the depicted coordinate system) of the aperture 402 is comparatively small. This provides an ion beam at the output of aperture 402 that is anisotropic. An anisotropic aperture is desirable in MS systems where only one of the transverse axes (e.g., y-axis in the embodiment depicted in FIG. 4) is sensitive to beam size and divergence. By allowing ions to fill the insensitive transverse direction, the ion charge density is reduced and consequently the effects of undesirable ion-ion repulsion are reduced. Illustratively, the aspect ratio (x/y) is approximately 0.01 to approximately 1.0.

In operation ions are introduced at the first end 209 and travel along trajectories (e.g., trajectory 405) in FIG. 4. The ions are reflected (e.g., at locations 406 and 407) by the RF field provided by the first and second pluralities of electrodes 302, 304. At the same time, the ions are subjected to a DC potential between the first end 209 and the second end 210 of the ion guide 400. This DC potential directs the ions in the z-direction toward the aperture 402.

As the ions approach the second end 210, the separation (x-direction) between the first plurality of electrodes 302 and the second plurality of electrodes 304 is reduced because of the taper of the ion guide 400, and the reflections by the first plurality of electrodes 302 and the second plurality of electrodes 304 are incident upon and reflected at a shallower angle relative to the respective normal vectors to the first and second pluralities of electrodes 302, 304. As such, compared to the reflection at location 406, the angles of reflection (relative to the normal) of the ions by the first and second pluralities of electrodes 302, 304 are smaller. This results in a comparative increase in the transverse kinetic energy of the ions at the second end 210 compared to the first end 209 of the ion guide 400. Specifically, the confinement through reflection of ions as they travel from the first end 209 and the second end 210 of the ion guide 400 results in an increase in their velocity components in the x direction and in the y direction of the coordinate system of FIG. 4. The increase in the transverse (x,y) velocity components of the ions as they travel from the first end 209 to the second end 210 of the ion guide 400 results in commensurate increases in their kinetic energies on the transverse (x and y) directions of the coordinate system depicted in FIG. 4. This increase in the transverse components of the kinetic energy would normally increase the divergence of the ion beam upon exit of the aperture 402. However, the inclusion of the buffer gas between the first and second pluralities of electrodes 302, 304 serves to reduce the transverse components of the velocities (and kinetic energy) of the ions in the transverse direction. As a result of the collisional "cooling" or "thermalizing" of the ions provided by the buffer gas, the ion beam that emerges from the aperture 402 is "brighter" (i.e., more confined with a comparable angular divergence) than that provided by known ion guides. Beneficially, the ion beam that emerges from the aperture 402 has a sufficiently low emittance to pass through a slicer (not shown). As is known, the emittance is defined as the product beam spatial size and angular spread at a beam focus. By the present teachings, ion beams have emittance values of approximately 0.1 mm·mrad to approximately 10 mm·mrad.

Figure 5A:
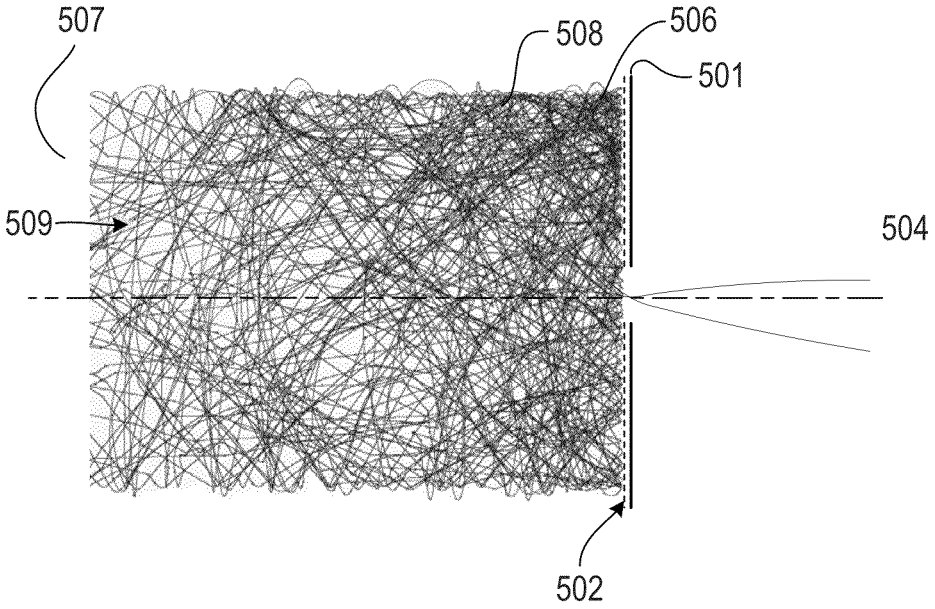
FIG. 5A shows a cross-sectional view of an ion guide in accordance with a representative embodiment.

FIG. 5A shows a cross-sectional view of an ion guide 500 in accordance with a representative embodiment. In the representative embodiment, an exit lens 501 comprising a plurality of electrodes 502 is provided at an output of a known ion guide or other structure useful in containing ions in an MS device. For example, the known ion guide may comprise a plurality of rods configured to confine ions such as described in the incorporated commonly owned patent and patent application publication set forth above.

The exit lens 501 comprises an aperture 503 through which a more confined ion beam emerges after being guided and cooled in the known ion guide. The exit lens 501 replaces what is conventionally the exit aperture or exit lens of a known ion guide. The ion beam emerges substantially orthogonal to the exit lens 501 through aperture 503. Like the ion guides described in connection with representative embodiments above, the aperture 503 can be rather small in order to confine the ion beam at its output. For example, the aperture 503 may be circular in cross-section and have a diameter of approximately 50 μm. As described below, and like the ion beams confined in accordance with representative embodiments above, the ion beam that emerges from the aperture 503 is "brighter" (i.e., more confined with a comparable angular divergence) than can be realized by known ion guides.

Figure 5B:
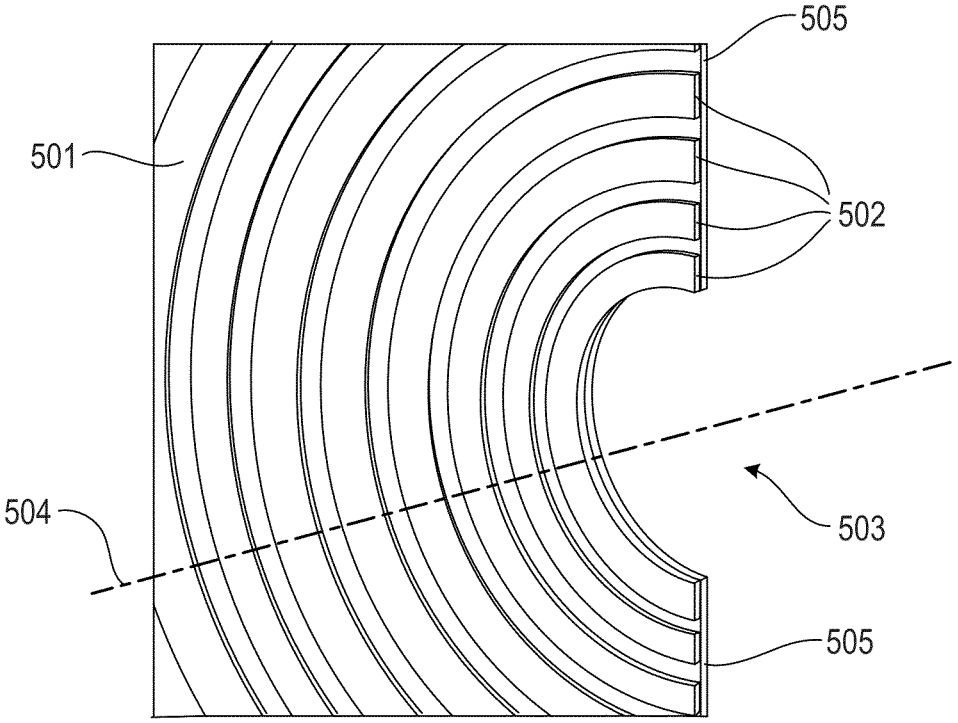
FIG. 5B shows a perspective view of an exit lens in accordance with a representative embodiment.

Turning to FIGS. 5A and 5B, the exit lens 501 comprises a plurality of electrodes 502 that are arranged in concentric circles about an axis 504 through the center of the aperture 503. The plurality of electrodes 502 are provided over a substrate 505. The electrodes 502 and the substrate 505 may be fabricated from the materials used for the substrates and pluralities of electrodes of the representative embodiments described above in connection with FIGS. 2 through 4. The electrodes 502 have a width (radial dimension) of approximately 5 μm and a pitch of approximately 10 μm, although the width and pitch of the electrodes 502 are contemplated to be approximately 1 μm to approximately 100 μm, and approximately 2 μm to approximately 500 μm respectively.

Ions are directed along the z-axis in the coordinate system depicted in FIG. 5A by a DC electric field established, for example, by the rod electrodes (e.g., see FIG. 6) such as described in U.S. Patent Application Publication 20100301210 or U.S. Pat. No. 7,064,322, incorporated by reference above.

The exit lens 501 comprising aperture 503 replaces the exit aperture or exit lens of a known ion guide, such as a rod ion guide or a stacked ring ion guide. An RF voltage is applied between adjacent pairs of electrodes 502 to create an electrodynamic field that creates a repulsive force on ions in the −z direction of the coordinate system depicted in FIG. 5A. As such, the electrodynamic field repels ions as they approach the exit lens 501 under the influence of the DC electric field that propels the ions in the +z direction and toward the aperture 503. Without the electrodynamic field created by the exit lens 501, ions being directed by the DC electric field would be incident on the exit aperture or exit lens and be lost. Moreover, as noted above, the collection of ions at the exit aperture or exit lens of a known ion guide can create unwanted electrostatic fields in the region near the exit lens. The electrodynamic field beneficially prevents the loss of ions on the exit lens 501 by repelling the ions back (in the −z direction in the depicted coordinate system) and in a region 506 between the electrodes of the known ion guide.

As depicted in FIG. 5A, as ions are directed in the +z direction by the DC electric field from a first end 507 toward the exit lens 501 they are reflected by the ion carpet in the −z direction. So, the concentration of ions at a region 508 is greater than the concentration at a region 509 (where the "lines" in regions 508 and 509 approximate the trajectories of ions). Like the ion guides 200~400 of the representative embodiments described above, the ion guide 500 comprises a buffer gas in the region 506. This buffer gas serves to collisionally cool the ions that are reflected by the exit lens 501. The cooled ions are directed by the DC electric field toward the aperture 503. The resulting ion beam has a desirably small emittance so that a substantial portion of the ion beam passes through the subsequent slicer apertures. In a manner similar to that described above in connection with ion guides 200~400, by virtue of the exit lens 501, the emergent ion beam is more spatially confined with a comparable angular divergence (i.e., "brighter") than ion beams of known ion guides.

By incorporating a comparatively small aperture 503, the emittance of the exiting beam is small enough that a substantial portion of the ion beam passes through the subsequent apertures of the MS system.

Figure 6:
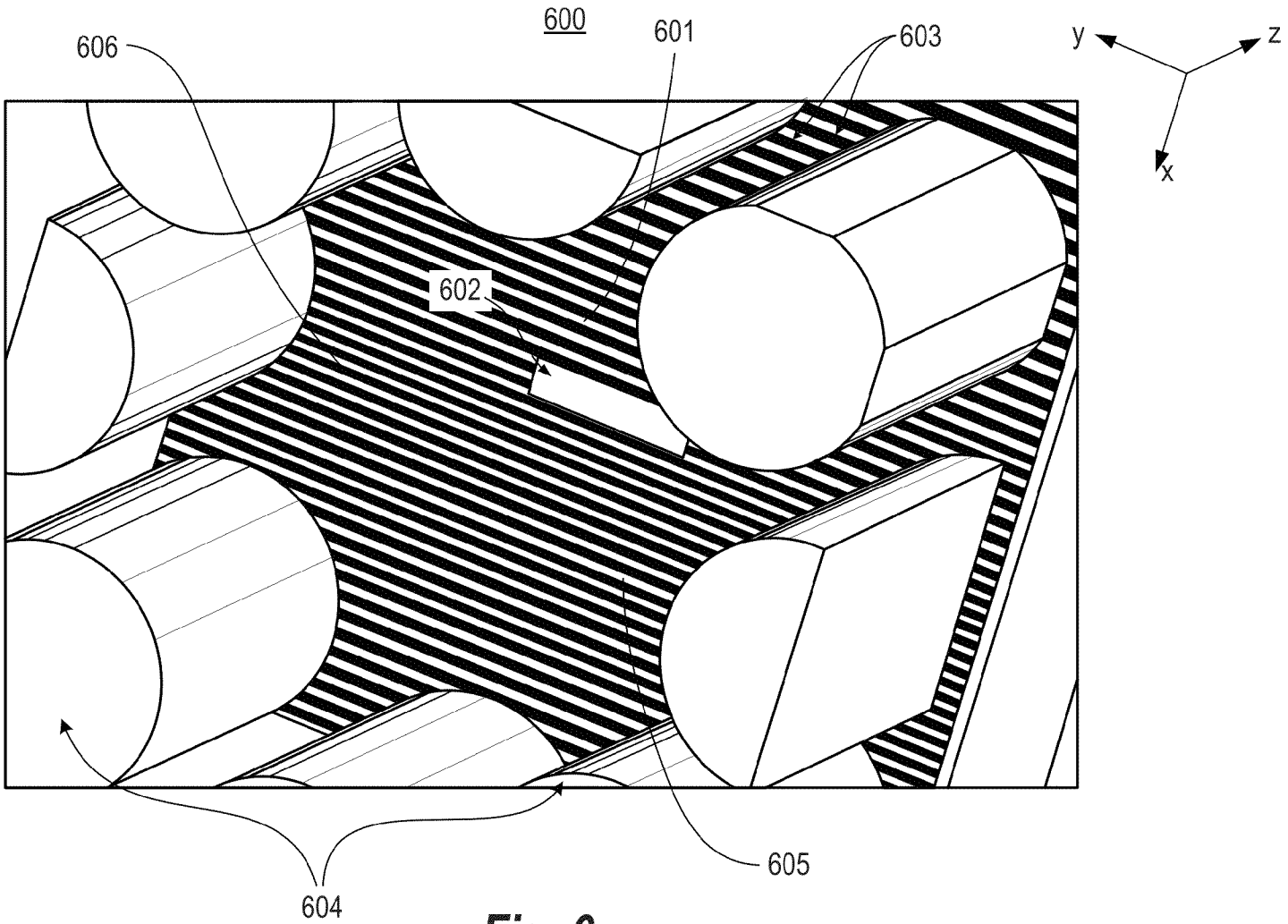
FIG. 6 shows a perspective view of an ion guide in accordance with a representative embodiment.

FIG. 6 shows a perspective view of an ion guide 600 in accordance with a representative embodiment. Many details of the components and their materials and function are similar if not identical to the description of ion guide 500 presented above. These common details may not be repeated in order to avoid obscuring the description of the presently described embodiment.

In the representative embodiment, an exit lens 601 comprises an aperture 602 and a plurality of electrodes 603 is provided at an output of a known ion guide or other structure useful in containing ions in an MS device. For example, the known ion guide comprises a plurality of rods 604 configured to confine ions such as described in the incorporated commonly owned patent and patent application publication set forth above.

As described above, an RF voltage is applied between adjacent pairs of the plurality of electrodes 603 that creates an electrodynamic field. The electrodynamic field is maintained close to a surface 605 of the exit lens 601 and repels ions as they approach the exit lens 601 under the influence of the DC electric field from the rods 604 that propels the ions in the +z direction and toward the aperture 602. Without the electrodynamic field created by the plurality of electrodes 603 of the exit lens 601, ions being directed by the DC electric field would be incident on the surface 605 (x-y plane of the coordinate system of FIG. 6) of the exit lens 601 and be lost. Moreover, as noted above, the collection of ions (space charge) on the surface 605 of the exit lens 601 can create unwanted electrostatic fields in the region near the exit lens. The exit lens 601 beneficially prevents the collection of ions by repelling the ions back (in the −z direction) and in a region 606 between the rods 604.

The exit lens 601 replaces what is conventionally the exit aperture or exit lens of a known ion guide such as a stacked ring ion guide. Like the ion guides described in connection with representative embodiments above, the aperture 602 can be rather small in order to confine the ion beam at its output. For example, the aperture 602 may be rectangular in cross-section as depicted in FIG. 6 and have a width (dimension in the y-direction of the coordinate system of FIG. 6) of approximately 500 μm and a height (dimension in the x-direction) of approximately 50 μm. Illustratively, the pitch of the plurality of electrodes 603 is approximately 10 μm. As described above, by providing a plurality of electrodes that have comparatively narrow width and small pitch, the electrodynamic field created by the application of an RF voltage to the each of the plurality of electrodes 603 is maintained close to the surface 605 of the exit lens 601.

By using such a small aperture 602, the emittance of the exiting beam is small enough that a substantial portion of the ion beam passes through the subsequent apertures. In the particular case shown in the figure, the aperture 602 is rectangular and the plurality of electrodes 603 are parallel linear electrodes. In fact, in many systems it is likely to be advantageous to have an asymmetric, high aspect ratio, exit aperture, such as aperture 602. As noted above, this asymmetry beneficially reduces the undesired effects of ion-ion repulsion by reducing the charge density.

Like the ion beams confined in accordance with representative embodiments above, the ion beam that emerges from the aperture 602 is "brighter" (i.e., more confined with a comparable angular divergence) than can be realized by known ion guides.

Figure 7:
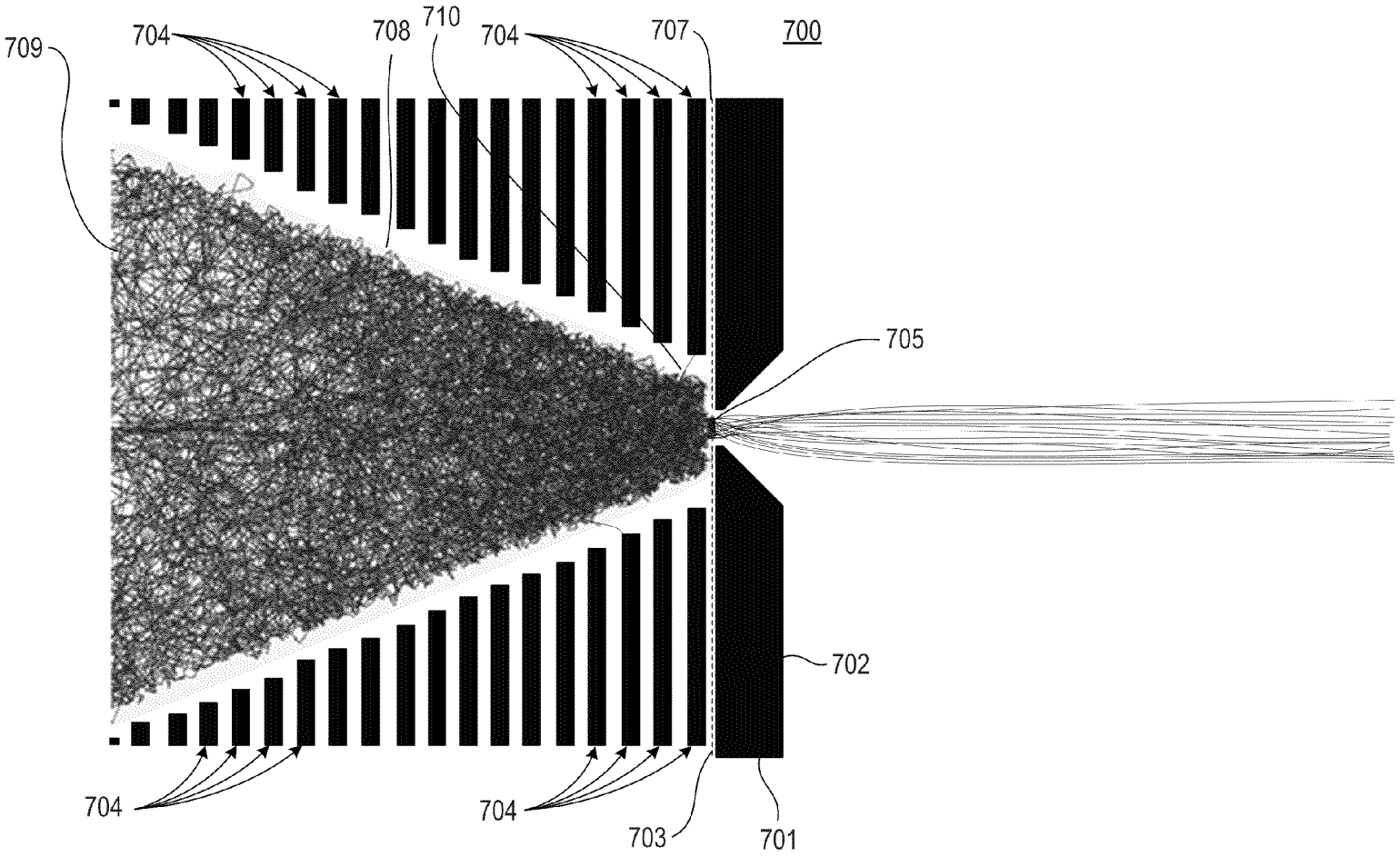
FIG. 7 shows a cross-sectional view of an ion guide in accordance with a representative embodiment.

FIG. 7 shows a cross-sectional view of an ion guide 700 in accordance with a representative embodiment. In the representative embodiment, an exit lens 701 comprising a substrate 702 and a plurality of electrodes 703 disposed over the substrate 702 is provided at an output of a known ion guide or other structure useful in containing ions in an MS device. The plurality of electrodes 703 may be concentric circular electrodes such as described in connection with the embodiments of FIGS. 5A, 5B. Alternatively, the plurality of electrodes 703 may be parallel linear electrodes such as described in connection with the embodiments of FIG. 6.

The known ion guide comprises a plurality of electrodes 704 configured to confine ions. Illustratively, the electrodes 704 comprise a series of electrodes having consecutively narrower openings in the z-direction and closer to an aperture 705 of exit lens 701. The electrodes 704 may be as described, for example in U.S. Pat. No. 6,107,628 to Smith, et al.; U.S. Pat. No. 6,583,408 to Smith, et al.; and U.S. Pat. No. 7,495,212 to Kim, et al. The respective entire disclosures of the Smith, et al. patents and the Kim, et al. patent are specifically incorporated herein by reference.

In the representative embodiment, exit lens 701 comprises an aperture 705. As described above, an RF voltage is applied between adjacent pairs of the plurality of electrodes 703 that creates an electrodynamic field. The electrodynamic field is maintained close to the surface of the exit lens 701 and repels ions as they approach the exit lens 701 under the influence of the DC electric field from the electrodes 704 that propels the ions in the +z direction and toward the aperture 602. Without the electrodynamic field created by the plurality of electrodes 703 of the exit lens 701, ions being directed by the DC electric field would be incident on a surface 707 (in the x-y plane of the coordinate system of FIG. 7) of the substrate 702 and be lost. Moreover, as noted above, the collection of ions (space charge) on the surface 707 can create unwanted electrostatic fields in the region near the exit lens 701. The exit lens 701 beneficially prevents the collection of ions by repelling the ions back (in the −z direction) and in a region 708 between the electrodes 704.

Trajectories of ions are depicted as lines in the region 708. At an entrance 709 of the ion guide 700, the ions are less confined (lines of the trajectories are less dense). However, the ions are more confined adjacent to the exit lens 701, for example in region 710. So, through a combination of increased ion confinement provided by the electrodes 704, the reflection of ions by the exit lens 701 and the cooling effect of the buffer gas (not shown) provided in the region 708, a comparatively more confined ion beam with a comparable angular divergence (i.e. "brighter") is realized.

As noted above, many known ion confinement structures and ion guides are limited in function except at comparatively low pressures (e.g., 30 Torr or lower), yet the transition from the ion source to the vacuum chamber can span pressures from near atmospheric pressure (760 Torr) at the ion source to high vacuum levels from $10^{-4}$ Torr to $10^{-8}$ Torr in the MS vacuum chamber. While many known multipole (e.g., rod and stacked ring) ion guides are configured to function at comparatively low pressures (e.g., in the MS vacuum chamber), their function at higher pressures is unacceptable. Most notably, at higher pressures (e.g., above approximately 30 Torr), electrostatic breakdown can occur at unacceptably low breakdown voltages ($V_B$). One factor that contributes to the breakdown is the comparatively large gap or distance between the electrodes in these known devices. Because the gap is comparatively large and the mean-free path of electrons is comparatively small, the number of electron scattering events is comparatively great. This results in electrical breakdown of the medium in the known ion guide.

Paschen's law can provide a better understanding of the breakdown voltage of the medium based. Paschen's law provides the relationship of the breakdown voltage ($V_B$) of gas between parallel plates (electrodes) as a function of pressure. The Paschen curve depicts the breakdown voltage ($V_B$) versus the product of the pressure and gap distance (pd). For a given medium, the Paschen curve has a minimum breakdown voltage. To the "left" (lower pd) of the minimum breakdown voltage, the breakdown voltage increases. To the "right" (higher pd) of the minimum breakdown voltage of the Paschen curve for the particular medium also increases. Operation to the "right" of the Paschen curve minimum results in a reduction in the breakdown voltage with decreasing pressure, which is undesirable. As such, the present teachings contemplate selection of the gap distance and pressure for operation to the "left" of the minimum breakdown voltage of the Paschen curve. Specifically, and as described in more detail below, the electrode-to-electrode gap is reduced compared to known ion guide structure to foster operation at higher pressures. This results in a significant reduction in the scattering events between the gaps. In this way, ion guidance from the ion source (nominally at atmospheric pressure) and across the path to the MS vacuum chamber is significantly improved with lower ion losses due to poor confinement and guidance.

Figure 8:
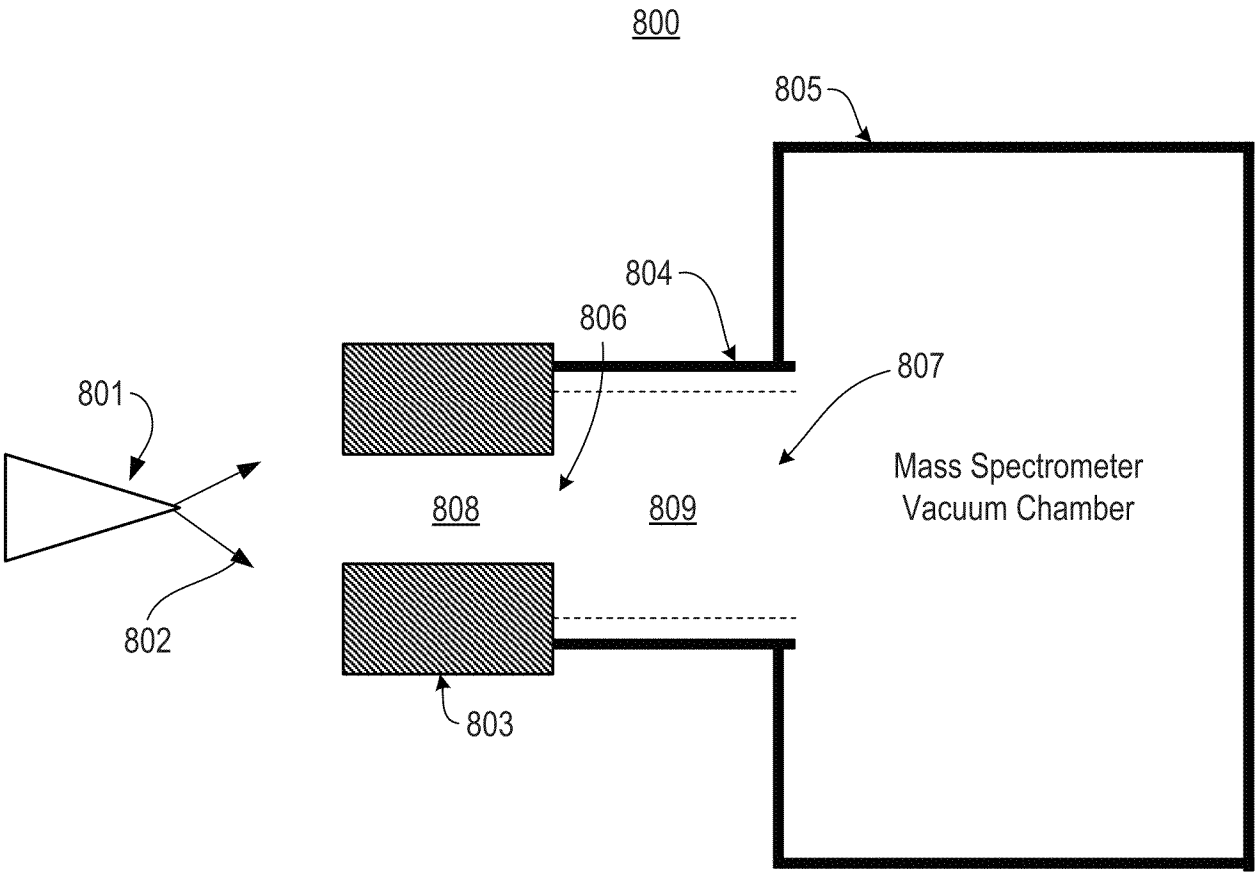
FIG. 8 shows a simplified block diagram of an MS system in accordance with a representative embodiment.

FIG. 8 shows a simplified block diagram of an MS system 800 in accordance with a representative embodiment. The MS system 800 comprises an ion source 801 that provides ions 802 to a gas restrictor 803 ("inlet"). The MS system 800 comprises an ion guide 804. Notably, the gas restrictor 803 can be an interface capillary and may have a round or circular cross-section. Alternatively, the gas restrictor 803 may have a cross-sectional shape to match the cross-sectional shape of the ion guide 804 (e.g., rectangular). Beneficially, "flat" gas restrictors offer better beam matching to the planar sides of ion guide 804, as well as improved transmission characteristics when effects such as ion diffusion and ion-ion repulsions are considered.

The MS system 800 also comprises an MS vacuum chamber 805. The MS vacuum chamber 805 comprises various components of the MS system 800 such as ion guides, ion optics and other components commonly operated at comparatively low pressure.

The ion source 801 is operated at a comparatively high pressure (e.g. 760 Torr) and as explained more fully below, the ion guide 804 is configured to operate at comparatively higher pressure as ions are delivered over decreasing pressures between the ion source 801 and the MS vacuum chamber 805.

The ion guide 804 comprises at least two opposing substrates each comprising a plurality of electrodes disposed thereover, such as ion guides 200, 300 of representative embodiments. In the representative embodiment, the ion guide 804 comprises a first opening 806 and a second opening 807 opposing the first opening 806. The first and second openings 806, 807 are depicted as being substantially the same area (i.e., the opposing substrates of the ion guide are parallel). However, this is merely illustrative, and it is contemplated that the area of the first opening 806 is greater than the second opening 807 (e.g., as depicted in FIG. 2).

The pressure in region 808 at the gas restrictor 803 is comparatively high (e.g., on the order of atmospheric pressure). Thus, at the first opening 806 of the ion guide 804, the pressure remains comparatively high. However, in region 809 near the second opening 807 of the ion guide 804, the pressure is reduced. For purposes of illustration, the pressure in region 808 is in the range of approximately 300 Torr to approximately 760 Torr, whereas in region 809 the pressure is in the range of approximately 30 Torr to approximately 3 Torr. Finally, the pressure in the MS vacuum chamber 805 is comparatively low (e.g., $10^{-4}$ Torr to $10^{-8}$ Torr). Beneficially, the ion guide 804 of the present teachings is configured to confine and guide ions over the change in pressure from the first opening 806 to the second opening 807. Stated somewhat differently, the ion guide 804 is configured to operate to the "left" of the minimum breakdown voltage of the Paschen curve (also referred to as the Paschen curve minimum). In this way, as the pressure is reduced, the breakdown voltage ($V_B$) is increased, and issues such as breakdown at higher pressures that are common in known multipole ion guides are substantially avoided by the ion guides of the present teachings.

To ensure operation to the "left" of the Paschen curve minimum the gap between electrodes is selected to be small enough that over a range of comparatively higher pressures (e.g., atmospheric pressure to approximately 30 Torr) electrical breakdown is avoided. For purposes of illustration, the Paschen curve minimum for air is near the pressure-gap product (p-d of the Paschen curve) of 1 atm-8 μm and occurs at a voltage of approximately 330 V. As such, with the spacing of the electrodes in ion guide 804 selected to be approximately 8 μm or less, at approximately atmospheric pressure (or lower) the ion guide 804 can function without breakdown. As noted above, the present teachings electrodes of representative embodiments have a width of approximately 5 μm to approximately 500 μm, a thickness of approximately 0.1 μm to approximately 50 μm, and a pitch of approximately 10 μm to approximately 1000 μm. As such, the gap between electrodes, which sets in part the Paschen minimum, can be selected to be less than approximately 8 μm, and the ion guide 804 can operate over the entire pressure range from the pressure (e.g., approximately 760 Torr) at the ion source 801 to the MS vacuum chamber 805 (e.g., $10^{-4}$ Torr to $10^{-8}$ Torr) and pressures there between along the ion path without concern of breakdown.

Figure 9:
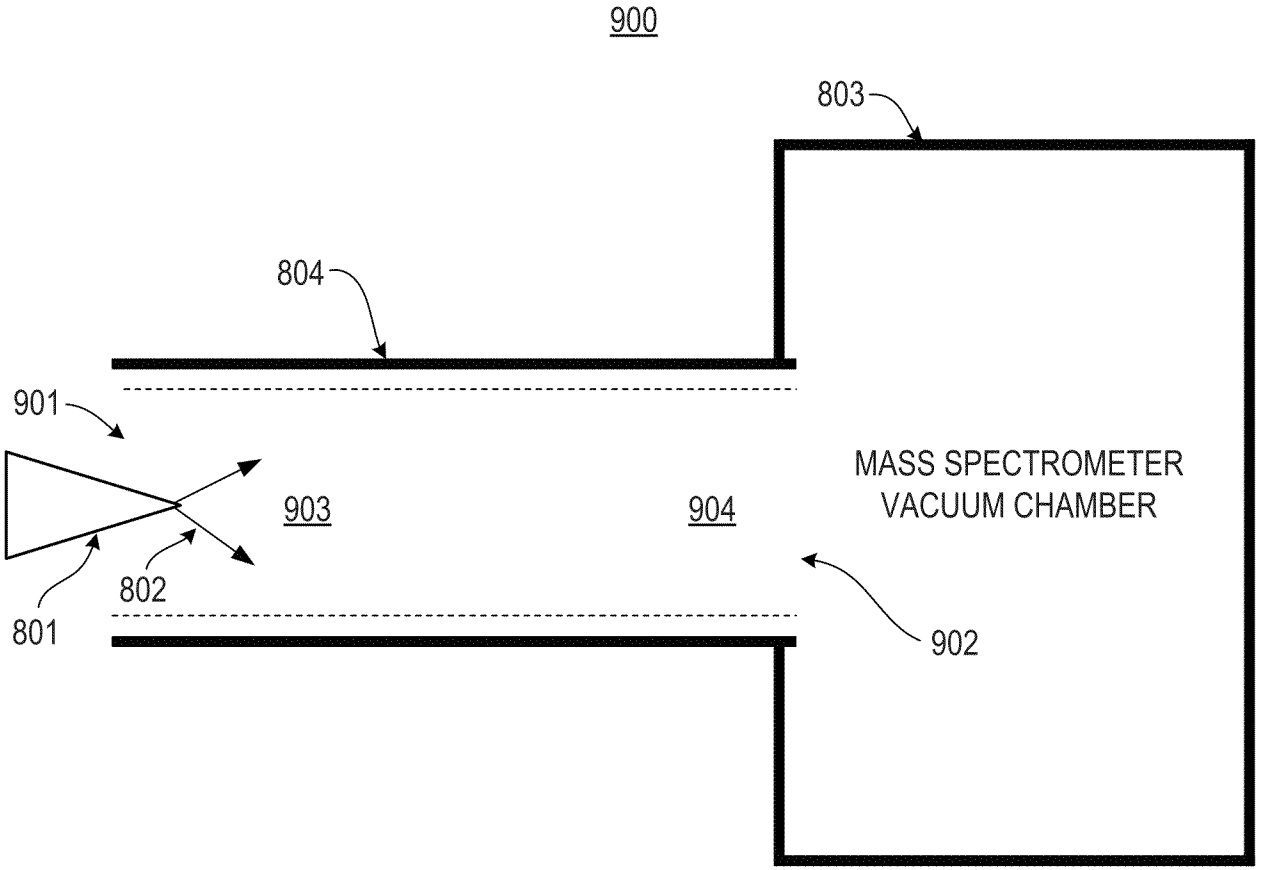
FIG. 9 shows a simplified block diagram of an MS system in accordance with a representative embodiment.

FIG. 9 shows a simplified block diagram of an MS system 900 in accordance with a representative embodiment. The MS system 900 comprises ion source 801 that provides ions 802 directly to ion guide 804 (i.e., without an intermediate element such as gas restrictor 803). Notably, in the depicted embodiment, the ion guide 804 serves as the interface capillary of the MS system 900. As noted above, "flat" gas restrictors offer better beam matching to the planar sides of ion guide 804, as well as improved transmission characteristics when effects such as ion diffusion and ion-ion repulsions are considered. As such, use of the ion guide 804 as the interface capillary of the MS system 900 provides improved transmission characteristics.

The MS system 900 comprises MS vacuum chamber 805, which includes various components of the MS system 900 such as ion guides, ion optics and other components commonly operated at comparatively low pressure.

The ion source 801 is operated at a comparatively high pressure (e.g. 760 Torr) and the ion guide 804 is configured to operate at comparatively higher pressure as ions are delivered over decreasing pressures between the ion source 801 and the MS vacuum chamber 805.

The ion guide 804 comprises at least two opposing substrates each comprising a plurality of electrodes disposed thereover, such as ion guides 200, 300 of representative embodiments. In the representative embodiment, the ion guide 804 comprises a first opening 901 and a second opening 902 opposing the first opening 901. The first and second openings 901, 902 are depicted as being substantially the same area (i.e., the opposing substrates of the ion guide are parallel). However, this is merely illustrative, and it is contemplated that the area of the first opening 901 is greater than the second opening 902 (e.g., as depicted in FIG. 2).

The pressure in region 903 near the first opening 901 is comparatively high (e.g., on the order of atmospheric pressure). Thus, at the first opening 901 of the ion guide 804, the pressure remains comparatively high. However, in region 904 near the second opening 902 of the ion guide 804, the pressure is reduced. Again, for purposes of illustration, the pressure in region 903 is in the range of approximately 300 Torr to approximately 760 Torr, whereas in region 904 the pressure is in the range of approximately 30 Torr to approximately 3 Torr. Finally, the pressure in the MS vacuum chamber 805 is comparatively low (e.g., $10^{-4}$ Torr to $10^{-8}$ Torr). Beneficially, the ion guide 804 of the present teachings is configured to confine and guide ions over the change in pressure from the first opening 806 to the second opening 807. Stated somewhat differently, the ion guide 804 is configured to operate to the "left" of the minimum breakdown voltage of the Paschen curve (also referred to as the Paschen curve minimum). In this way, as the pressure is reduced, the breakdown voltage ($V_B$) is increased, and issues such as breakdown at higher pressures that are common in known multipole ion guides are substantially avoided by the ion guides of the present teachings.

To ensure operation to the "left" of the Paschen curve minimum the gap between electrodes is selected to be small enough that over a range of comparatively higher pressures (e.g., atmospheric pressure to approximately 30 Torr) electrical breakdown is avoided. For purposes of illustration, the Paschen curve minimum for air is near the pressure-gap product (p-d of the Paschen curve) of 1 atm-8 μm and occurs at a voltage of approximately 330 V. As such, with the spacing of the electrodes in ion guide 804 selected to be approximately 8 μm or less, at approximately atmospheric pressure (or lower) the ion guide 804 can function without breakdown. As noted above, the present teachings electrodes of representative embodiments have a width of approximately 5 μm to approximately 500 μm, a thickness of approximately 0.1 μm to approximately 50 μm, and a pitch of approximately 10 μm to approximately 1000 μm. As such, the gap between electrodes, which sets in part the Paschen minimum, can be selected to be less than approximately 8 μm, and the ion guide 804 can operate over the entire pressure range from the pressure (approximately 760 Torr) at the ion source 801 to the MS vacuum chamber 805 (e.g., $10^{-4}$ Torr to $10^{-8}$ Torr) and pressures therebetween along the ion path without concern of breakdown.

Figure 10:
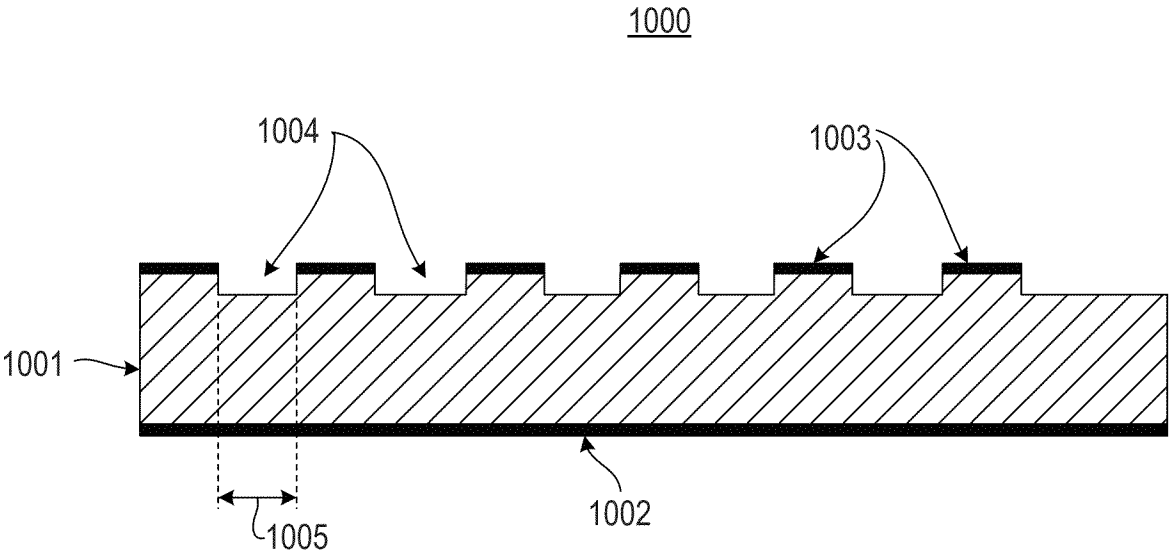
FIG. 10 shows a cross-sectional view of a portion of an ion guide in accordance with a representative embodiment.

FIG. 10 shows a cross-sectional view of a section 1000 of an ion guide in accordance with a representative embodiment. The section 1000 is a portion of one side of the ion guide and is presented to describe certain variations in the structure to further improve the performance of ion guides operating in comparatively high pressures (e.g., greater than approximately 30 Torr). Many aspects of the section 1000 of the ion guide are described above in detail in connection with other representative embodiment. These common aspects are not repeated to avoid obscuring the description of the representative embodiments.

The section 1000 comprises a substrate 1001 comprising a dielectric material, with an electrically conductive ground plane 1002 disposed over one side of the substrate 1001 and a plurality of electrodes 1003 disposed over an opposing side of the substrate 1001. Moreover, a plurality of trenches 1004 are provided between the electrodes 1003. The trenches 1004 are formed for example by etching the substrate 1001. The trenches have a width 1005 equal to the spacing between adjacent pairs of electrodes 1003. The trenches 1004 have a depth 1006 that is on the order of approximately one to approximately three (3) times greater than the width of electrodes 1003. As such, the trenches 1004 have a depth of approximately 5 μm to approximately 15 μm (i.e., for electrodes 1003 having a width of approximately 500 μm.

The trenches reduce the occurrence of electrical breakdown across the surface of the substrate 1001 and between the electrodes 1003 (a phenomenon known as "flashover"). Notably, trenches 1004 also serve to reduce the capacitance of the ion guide, which in turn helps to minimize the RF current and ultimately the power dissipated through the ion guide. Furthermore, dielectric/insulator removed from the substrate 1001 to form the trenches, thereby increasing the distance between the bottom of the trenches 1004 and the ions (not shown) traversing the ion guide, which further reduces problems associated with charging. Specifically, ions deposited on the surface of a dielectric (e.g., the surface of substrate 1001) are not immediately neutralized as they are on a metal surface (e.g., the surface of electrodes 1003). As such, the ions that form on the surface of the substrate alter the electric field in the nearby region. The altered electric field repels ions and can block them from traversing the ion guide or cause them to be deflected. Providing trenches 1004 serves to locate the dielectric surface of substrate 1001 away from the region of ion confinement, thereby reducing the ill-effects of charging that can accumulate on the surface of the substrate 1001.

In view of this disclosure it is noted that the methods and devices can be implemented in keeping with the present teachings. Further, the various components, materials, structures and parameters are included by way of illustration and example only and not in any limiting sense. In view of this disclosure, the present teachings can be implemented in other applications and components, materials, structures and equipment to needed implement these applications can be determined, while remaining within the scope of the appended claims.

The invention claimed is:

1. A mass spectrometer having an inlet that is maintained, at a first pressure and a region that is maintained at a second pressure that is less than the first pressure, the inlet configured to receive an ion guide, wherein the ion guide comprises:

a substrate comprising a plurality of electrodes disposed thereover, the substrate forming a first opening at a first end and a second opening at a second end, wherein the first opening is configured to receive ions at the first pressure;

a plurality of trenches provided in the substrate, wherein each of the plurality of trenches is provided between a respective adjacent pair of the plurality of electrodes;

means for applying a radio frequency (RF) voltage between adjacent pairs of the plurality of electrodes, wherein the RF voltage creates a field in a region defined by the substrate; and means for applying a direct current (DC) voltage drop along a length of each of the plurality of electrodes.

2. A mass spectrometer as claimed in claim 1, wherein each of the plurality of trenches has a width, and each of the trenches has a depth, and the depth is approximately one to three times greater than the width.

3. A mass spectrometer as claimed in claim 1, wherein the substrate is a first substrate and the plurality of electrodes is a first plurality of electrodes, the ion guide further comprising:

a second substrate comprising a second plurality of electrodes disposed thereover, the first substrate and the second substrate forming sides of the first opening at the first end and sides of the second opening at the second end.

4. A mass spectrometer as claimed in claim 3, wherein the first opening has a first area and the second opening has a second area that is less than the first area.

5. A mass spectrometer as claimed in claim 3, further comprising a third substrate disposed over a side wall of the ion guide and a fourth substrate disposed over another side wall of the ion guide.

6. A mass spectrometer as claimed in claim 5, wherein the third substrate comprises a third plurality of electrodes disposed thereover, and the fourth substrate comprises a fourth plurality of electrodes disposed thereover.

7. A mass spectrometer as claimed in claim 5, wherein the third substrate and the fourth substrate each comprise an electrically conductive material disposed over respective entire surfaces of the third and fourth substrates.

8. A mass spectrometer as claimed in claim 3, further comprising:

means for applying, a radio frequency (RF) voltage between adjacent pairs of the secon plurality of electrodes.

9. A mass spectrometer as claimed in claim 6, further comprising:

means for applying a radio frequency (RF) voltage between adjacent pairs of the third plurality of electrodes, and between adjacent pairs of the fourth plurality of electrodes.

* * * * *